US011091243B1

(12) United States Patent
Gable et al.

(10) Patent No.: US 11,091,243 B1
(45) Date of Patent: Aug. 17, 2021

(54) MARINE PROPULSION CONTROL SYSTEM AND METHOD

(71) Applicant: Brunswick Corporation, Mettawa, IL (US)

(72) Inventors: Kenneth G. Gable, Oshkosh, WI (US); Daniel E. Clarkson, Oshkosh, WI (US); Steven J. Andrasko, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/887,123

(22) Filed: May 29, 2020

(51) Int. Cl.

| | |
|---|---|
| ***B63H 25/46*** | (2006.01) |
| ***B63H 20/06*** | (2006.01) |
| ***B63H 20/12*** | (2006.01) |
| *B63H 20/00* | (2006.01) |

(52) U.S. Cl.
CPC ..... *B63H 25/46* (2013.01); *B63H 20/06* (2013.01); *B63H 20/12* (2013.01); *B63H 2020/003* (2013.01); *B63H 2025/465* (2013.01)

(58) Field of Classification Search
CPC ..... B63H 25/46; B63H 20/06; B63H 20/12; B63H 2020/003; B63H 2025/465
See application file for complete search history.

(56) References Cited

U.S. PATENT DOCUMENTS

| | | | | |
|---|---|---|---|---|
| 6,142,841 | A | 11/2000 | Alexander, Jr. et al. | |
| 6,234,853 | B1 | 5/2001 | Lanyi et al. | |
| 6,354,892 | B1 | 3/2002 | Staerzl | |
| 6,402,577 | B1 | 6/2002 | Treinen et al. | |
| 6,406,340 | B1 | 6/2002 | Fetchko et al. | |
| 7,222,577 | B2 * | 5/2007 | Morvillo | B63H 25/02 114/144 RE |
| 7,267,068 | B2 | 9/2007 | Bradley et al. | |
| 7,305,928 | B2 | 12/2007 | Bradley et al. | |
| 7,398,742 | B1 | 7/2008 | Gonring | |
| 7,467,595 | B1 | 12/2008 | Lanyi et al. | |
| 7,601,040 | B2 * | 10/2009 | Morvillo | B63H 21/21 440/1 |
| 8,060,265 | B2 | 11/2011 | Hallenstvedt et al. | |

(Continued)

FOREIGN PATENT DOCUMENTS

WO 2019214829 A1 11/2019

*Primary Examiner* — Stephen P Avila
(74) *Attorney, Agent, or Firm* — Andrus Intellectual Property Law, LLP

(57) ABSTRACT

A propulsion system on a marine vessel includes at least one steerable propulsion device and at least one lateral thruster. A steering wheel is mechanically connected to and operable by a user to steer the at least one propulsion device. A user interface device is operable by a user to provide at least a lateral thrust command to command lateral movement and a rotational thrust command to command rotational movement of the vessel. A controller is configured to determine a difference between a steering position of the propulsion device and a centered steering position. A user interface display is controllable to indicate at least one of the steering position of the propulsion device and the difference between the steering position and the centered steering position. The controller is further configured to determine that the steering position is within a threshold range of the centered steering position.

23 Claims, 10 Drawing Sheets

(56) References Cited

U.S. PATENT DOCUMENTS

| | | | | |
|---|---|---|---|---|
| 8,417,399 | B2 | 4/2013 | Arbuckle et al. | |
| 8,512,085 | B1 | 8/2013 | Kobilic | |
| 8,777,681 | B1 | 7/2014 | McNalley et al. | |
| 8,807,059 | B1 | 8/2014 | Samples et al. | |
| 9,039,468 | B1 | 5/2015 | Arbuckle et al. | |
| 9,132,902 | B2 | 9/2015 | Angelle | |
| 9,132,903 | B1 | 9/2015 | Gable et al. | |
| 9,248,898 | B1 | 2/2016 | Kirchhoff et al. | |
| 10,259,555 | B2 | 4/2019 | Ward et al. | |
| 10,913,524 | B1 * | 2/2021 | Wald | B63H 25/42 |
| 2009/0197486 | A1 | 8/2009 | Szilagyi et al. | |

* cited by examiner

ROTATIONAL

LATERAL

MARINE PROPULSION CONTROL SYSTEM AND METHOD

FIELD

The present disclosure generally relates to methods and systems for propelling marine vessels, and more particularly to systems and methods for providing lateral and rotational propulsion with mechanically steered or other non-steer-by-wire steering arrangement.

BACKGROUND

Many different types of marine propulsion devices are well known to those skilled in the art. For example, outboard motors that are attached to the transom of a marine vessel, stern drive systems that extend in a rearward direction from the transom of a marine vessel, bow thrusters and other docking thrusters are well known to those skilled in the art. In addition to bow thrusters, certain types of docking thruster systems used in conjunction with marine vessels incorporate a plurality of propulsors that are responsive to the joystick manipulations or other control input by a marine vessel operator.

The following U.S. Patents are incorporated herein by reference, in entirety:

U.S. Pat. No. 6,234,853 discloses a docking system that utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 6,406,340 discloses a hydraulic steering assembly that applies a force to a tiller arms of twin marine, outboard propulsion units and rotates the propulsion units about a steering axis between a center position and hard over positions to each side of the center position. Each propulsion unit is supported for arcuate movement about a tilt axis which is generally perpendicular to the steering axis. There is a hydraulic steering apparatus mounted on a first of the propulsion units which includes a hydraulic cylinder pivotally connected to a member which is pivotally mounted on the tiller arm of the first propulsion unit. A tie-bar is pivotally connected to the steering apparatus and pivotally connected to the tiller arm of a second propulsion unit. For example, the tie-bar may be pivotally connected to the steering apparatus by a ball joint connected to the steering apparatus by a bracket which moves with the member.

U.S. Pat. No. 7,398,742 discloses a steering assist system providing differential thrusts by two or more marine propulsion devices in order to create a more effective turning moment on a marine vessel. The differential thrusts can be selected as a function of the magnitude of turn commanded by an operator of the marine vessel and, in addition, as a function of the speed of the marine vessel at the time when the turning command is received.

U.S. Pat. No. 7,467,595 discloses a method for controlling the movement of a marine vessel that rotates one of a pair of marine propulsion devices and controls the thrust magnitudes of two marine propulsion devices. A joystick is provided to allow the operator of the marine vessel to select port-starboard, forward-reverse, and rotational direction commands that are interpreted by a controller which then changes the angular position of at least one of a pair of marine propulsion devices relative to its steering axis.

U.S. Pat. No. 9,039,468 discloses a system that controls speed of a marine vessel that includes first and second propulsion devices that produce first and second thrusts to propel the marine vessel. A control circuit controls orientation of the propulsion devices between an aligned position in which the thrusts are parallel and an unaligned position in which the thrusts are non-parallel. A first user input device is moveable between a neutral position and a non-neutral detent position. When the first user input device is in the detent position and the propulsion devices are in the aligned position, the thrusts propel the marine vessel in a desired direction at a first speed. When a second user input device is actuated while the first user input device is in the detent position, the propulsion devices move into the unaligned position and propel the marine vessel in the desired direction at a second, decreased speed without altering the thrusts.

U.S. Pat. No. 10,259,555 discloses a method for controlling movement of a marine vessel near an object that includes accepting a signal representing a desired movement of the marine vessel from a joystick. A sensor senses a shortest distance between the object and the marine vessel and a direction of the object with respect to the marine vessel. A controller compares the desired movement of the marine vessel with the shortest distance and the direction. Based on the comparison, the controller selects whether to command the marine propulsion system to generate thrust to achieve the desired movement, or alternatively whether to command the marine propulsion system to generate thrust to achieve a modified movement that ensures the marine vessel maintains at least a predetermined range from the object. The marine propulsion system then generates thrust to achieve the desired movement or the modified movement, as commanded.

U.S. Pat. No. 8,512,085 discloses a tie bar apparatus is for a marine vessel having at least first and second marine drives. The tie bar apparatus comprises a linkage that is geometrically configured to connect the first and second marine drives together so that during turning movements of the marine vessel, the first and second marine drives steer about respective first and second vertical steering axes at different angles, respectively.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a propulsion system on a marine vessel includes at least one steerable propulsion device rotatable to steer a marine vessel and at least one lateral thruster configured to generate starboard and or port thrust on the marine vessel. A steering wheel is operable by a user to steer the at least one propulsion device, wherein the steering wheel is mechanically connected to the propulsion device such that the propulsion device is mechanically steered. A user interface device is operable by a user to provide at least a lateral thrust command to command lateral movement of the marine vessel and a rotational thrust command to command rotational movement of the marine vessel. A controller is configured to determine a steering position of the propulsion device and to determine a difference between that steering position and a centered steering position. A user interface device is controllable indicate at least one of the steering position of the propulsion device and the difference between the steering position and the centered steering position. The controller is further configured to determine that the steering position of the at least one propulsion device is within a threshold range of the centered steering position prior to enabling a joystick thrust control mode wherein thrust by the propulsion device and the lateral thruster is controllable by the user input device.

A method of controlling propulsion of a marine vessel includes detecting a steering position of at least one propulsion device and determining a difference between the detected steering position and a centered steering position. At least one of the detected steering position and the difference between the detected steering position and the centered steering position is indicated to a user on a user interface device. A controller requires that the detected steering position be within a threshold range of the centered steering position prior to enabling a joystick thrust control mode wherein thrust by the propulsion device and one or more lateral thrusters is controlled based on user input at a user input device.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1A:
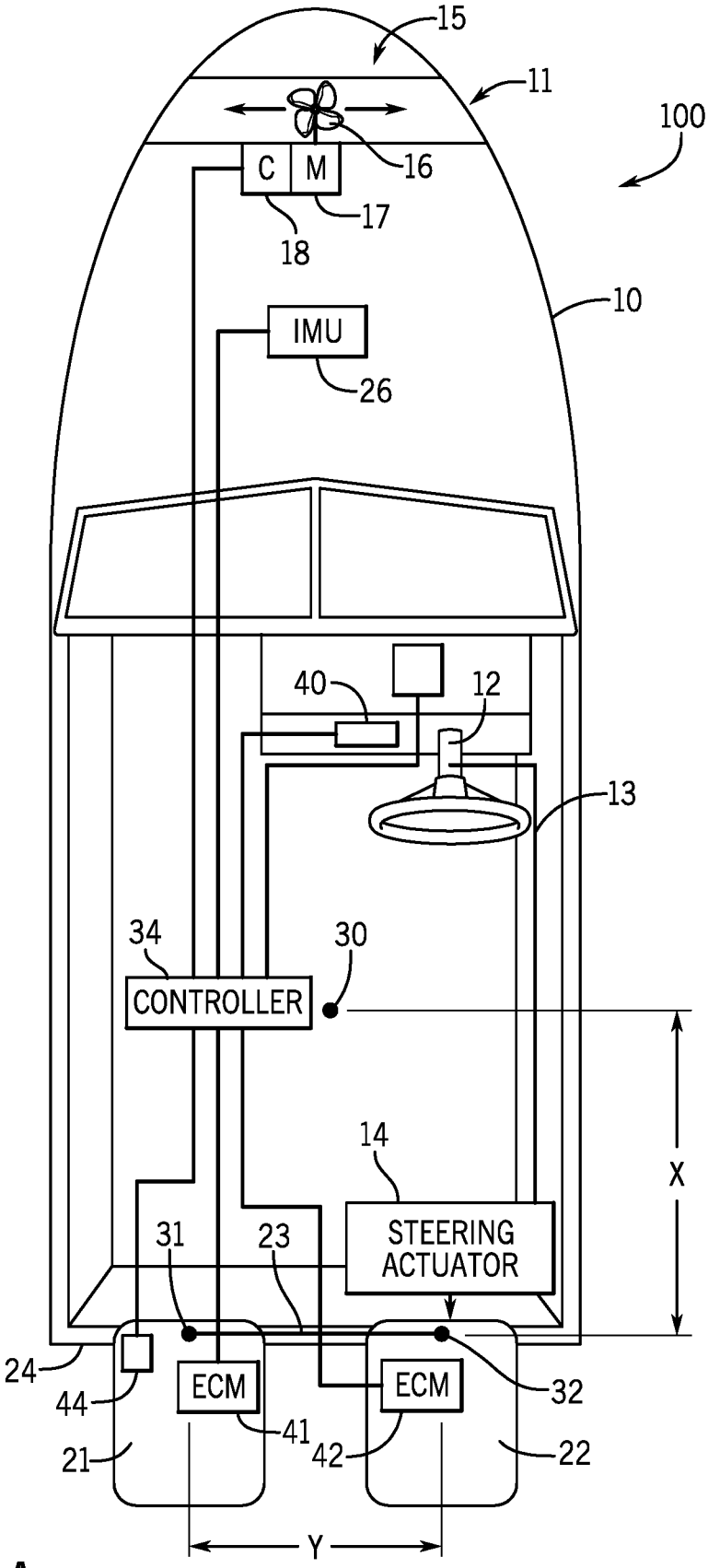
FIG. 1A-1B are schematic illustrations of marine vessels with embodiments of a propulsion system according to the present disclosure.

The inventors have recognized a need for vessel control systems that provide lateral and rotational user control, such as user control provided by standard joystick systems, for non-steered-by-wire vessels where a steering wheel is mechanically connected via a conventional steering system to propulsion devices mounted to the stern of the marine vessel. For example, on vessels configured for high speed applications, such as racing vessels, the mechanically-steered propulsion devices are typically tied together, such as with a tie bar. This provides robust steering actuation and control at high load conditions and high vessels speeds. As another example, lower cost vessels typically implement conventional mechanical steering systems where the propulsion devices are mechanically connected to the steering wheel and are jointly steered, and the propulsion devices are often connected with a tie bar. In both of these applications, as well as other non-steer-by-wire steering and propulsion systems, the propulsion devices are maintained in parallel such that the thrusts effectuated are parallel to one another. These existing systems do not provide lateral thrust control or automatic rotational thrust control where a user can instruct rotational movement without any forward or backward movement. No joysticking or other lateral thrust control elements are currently available for non-steer-by-wire systems. Currently available joysticking systems require steer-by-wire control where each propulsion device can be steered separately and the propulsion devices can be placed at angles that are not parallel to one another.

Based on the foregoing problems and challenges in the relevant art, the inventors developed the disclosed propulsion system and method allowing lateral and rotational steering control, such as via a joystick, on mechanically steered and other non-steer-by-wire vessels. The disclosed system and method enable lateral and rotational steering control by a user without controlling or adjusting the angle of the propulsion devices with respect to the marine vessel, and thus can be implemented on marine vessels with conventional mechanical steering of the propulsion devices.

The present inventors recognized that lateral and rotational steering control may be most effective and efficient if the drives remain in a centered position during lateral and rotational steering control by the joystick, keypad, or other user input device. Since the propulsion devices are mechanically steered and no electronic steering control is provided, the inventors have recognized that the needed steering changes in order to center the drives must be communicated to the user. The user can then center the drives by turning the steering wheel prior to enabling a joystick thrust control mode whereby lateral and rotational steering control is provided via a user input device, such as a joystick or a keypad. Various means of indicating at least one of a detected steering position and or a direction and amount that the user must turn the steering wheel in order to reach the centered steering position are disclosed herein.

In various embodiments, the disclosed propulsion system may include one or more steerable propulsion devices rotatable to steer a marine vessel, such as an outboard drive, a stern drive, or the like. In one embodiment, two or more parallel propulsion devices are mounted to the transom of the marine vessel that each generates forward and reverse thrusts. The propulsion devices remain parallel and may be connected together by a rigid tie-bar, examples of which are disclosed herein. A sensor system is configured to determine a steering position of the one or more propulsion devices. The system may further include one or more lateral thrusters configured to generate lateral thrust in each of the starboard and port directions. A user input device, such as a joystick or keypad, is manually operable by a user to provide at least lateral and rotational steering inputs to command corresponding movement of the marine vessel, and a controller is configured to control magnitude and direction of thrust by the propulsion devices and the lateral thruster to effectuate the commanded movement without requiring any steering control over the propulsion devices. The system is configured to require that the steerable propulsion devices are steered to a centered position during the joystick mode operation, and to communicate with the user in order to have them operate the steering wheel as needed to center the drives.

The inventors have further recognized that propulsion devices are not always visible from the helm of the marine vessel, such as with stern drives or with outboards on high-riding vessels, such as pontoon boats. Thus, it is not possible for the operator to visually determine the steering position of the drives. Moreover, the steering wheel position also may not be indicative of the steering position of the drives because most mechanical steering systems are configured to require several turns of the steering wheel to span the full range of steering angles of the propulsion devices. For example, some systems require up to six turns of the steering wheel lock-to-lock.

Figure 1B:
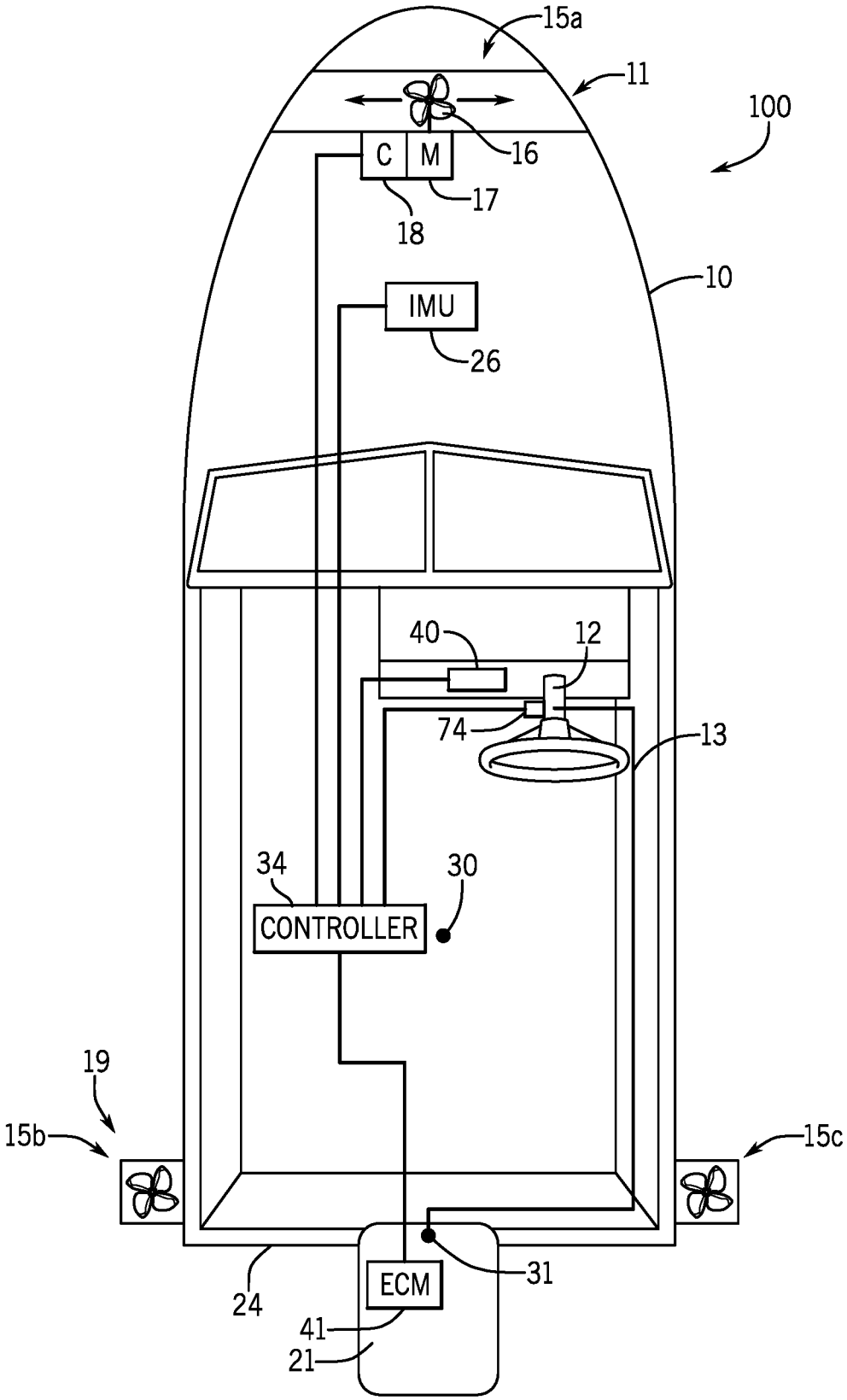

FIGS. 1A-1B are schematic representations of a marine vessel 10 equipped with propulsion system 100 including two propulsion devices 21 and 22 attached to the transom 24 and arranged in parallel. The number of propulsion devices is exemplary and a person having ordinary skill in the art will understand in light of the present disclosure that any number of two or more propulsion devices may be utilized in the disclosed system and method. In the depicted example, the propulsion devices 21 and 22 are connected and maintained in parallel via a tie bar 23. Tie bars are conventional in many marine applications, including high-speed racing vessels, which often employ tie bars between engines to assist in distributing steering loads during high-speed operations. The tie bars may attach to the propulsion devices at the location of the steering axes 31 and 32 of the parallel propulsion devices 21 and 22, respectively. The steering axes 31 and 32 are separated by a dimension Y and at a distance X from the center of turn 30 (COT), which could also be the effective center of gravity (COG). The marine vessel 10 is maneuvered by causing the first and second propulsion devices to rotate about their respective steering axis 31 and 32. The parallel propulsion devices 21 and 22 are rotated in response to an operator's manipulation of the steering wheel 12, which is mechanically connected to the steering actuator 14 which rotates the propulsion devices 21 and 22, as is conventional. Mechanical connection systems 13 for transmitting rotational movement of the steering wheel 12 to the steering actuator 14 are well-known, such as steering linkage systems and or cable systems, which may include hydraulic actuated steering systems. Rotating the parallel propulsion devices 21 and 22 and effectuating thrusts thereby cause rotation of the marine vessel 10 about the effective COT 30.

The propulsion system 100 includes one or more lateral thrusters 15 configured to effectuate lateral thrust on the vessel 10 in the starboard and port directions. In the example at FIG. 1A, the lateral thruster 15 is a bow thruster positioned at a bow region 11 of the vessel 10 and configured to effectuate lateral thrust on the bow 11. Bow thrusters are well-known to those skilled in the art, as are other types and locations of docking thruster systems configured to effectuate lateral thrusts on the marine vessel. A person having ordinary skill in the art will understand in view of the present disclosure that the disclosed propulsion system 100 may include other types and locations of lateral thrusters 15, which may be an alternative to or in addition to bow and stern lateral thrusters 15A-15C.

FIG. 1B shows another embodiment comprising only one propulsion device 21, which may be, for example, a single engine stern drive or outboard. In the embodiment at FIG. 1B, the propulsion system 100 includes a lateral thruster 15A positioned at the bow and two additional lateral thrusters 15B and 15C positioned at the stern 19 of the vessel 10. Each lateral thruster 15 (e.g. 15A-15C) includes a fan 16 or propeller that is rotated by a bidirectional motor 17 in forward or reverse direction in order to effectuate lateral thrust in the starboard and port directions. In certain embodiments, the stern lateral thrusters 15B-15C may be single-direction and may be configured to operate exclusively one at a time to effectuate respective starboard and port directional thrusts. The controller 34 may be communicatively connected to a controller 18 for the lateral thruster 15 in order to control activation and direction of thrust by the lateral thruster 15. In one embodiment, the rotation, and thus is either on or off and rotates in the clockwise and counter-clockwise directions at a single speed. In other embodiments, the lateral thruster 15 is a variable speed thruster wherein the motor 17 is controllable to rotate the fan 16 at two or more speeds. For example, the motor 17 may be a brushless DC motor configured for variable multi-speed control of the fan 16 in both the clockwise and counter-clockwise rotation directions.

The propulsion system 100 further includes a user-input device 40, such as a joystick or a keypad, operable by a user to provide at least a lateral steering input to command lateral movement of the marine vessel and a rotational steering input to command rotational movement of the marine vessel 10. The user steering inputs provided at the user-input device 40 are received at the controller 34 which is communicatively connected to the engine control module (ECM) 41 and 42 of each propulsion device 21 and 22, respectively. Thereby, the controller 34 can communicate instructions to each ECM 41 and 42 to effectuate a commanded magnitude of thrust and a commanded direction of thrust (forward or reverse), as is necessary to effectuate the lateral and/or rotational steering inputs commanded at the user input device 40.

Figure 2A:
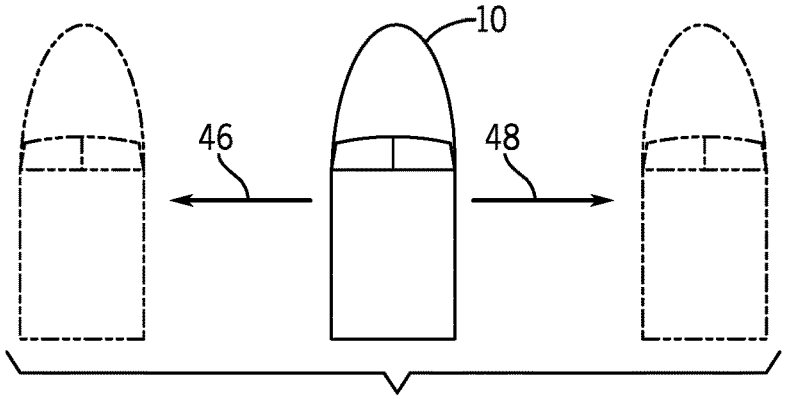
FIG. 2A-2E are schematic illustrations of various movements of a marine vessel.
Figure 2B:
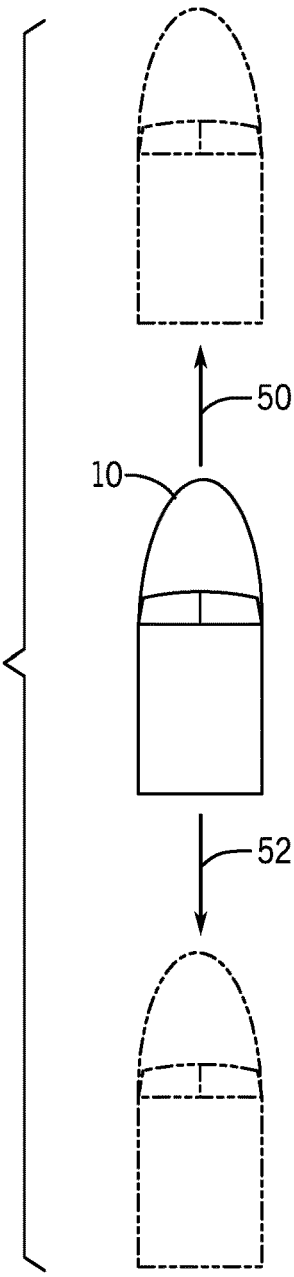
Figure 2C:
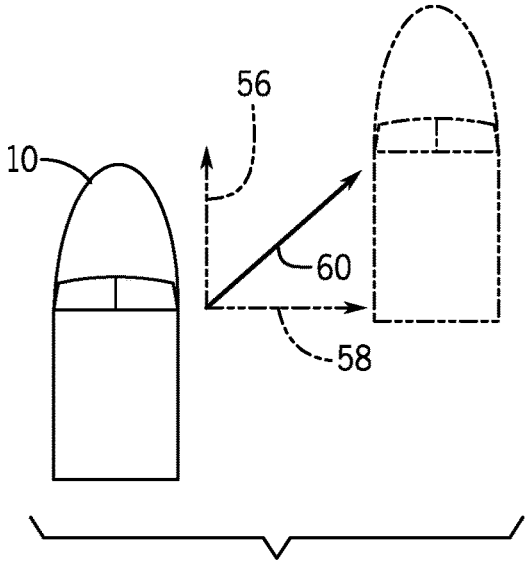
Figure 2D:
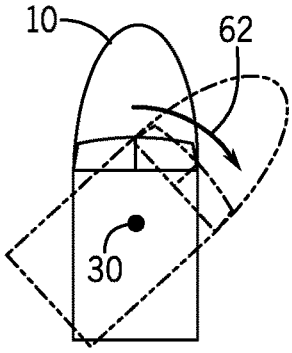
Figure 2E:
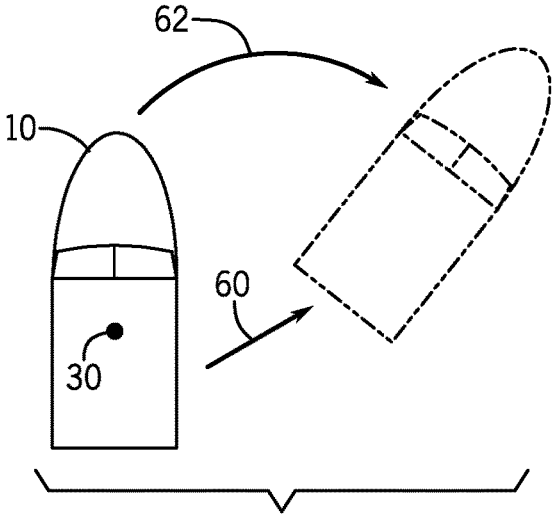

FIGS. 2A-2E illustrate exemplary vessel movements that may be commanded via the user-input device 40. In FIG. 2A, the vessel 10 is shown moving laterally in the port direction 46 and the starboard direction 48 without any forward or reverse motion and without any rotation about its COT 30. FIG. 2B shows the vessel 10 moving in the forward 50 direction and backward 52 direction. FIG. 2C shows a combination of forward and starboard motions of the vessel 10, where the forward movement is represented by the dashed arrow 56 and the starboard movement is represented by the dashed arrow 58. The resultant motion vector 60 moves the vessel in the forward and starboard directions without any rotation. FIG. 2D illustrates a clockwise rotation 62 of the marine vessel 10 about the COT 30 without any translation movement, including any forward/reverse movement or lateral movement. FIG. 2E illustrates a combination of rotation 62 and translation 60, which is in both the forward and starboard directions.

The disclosed system and method enable lateral and rotational movement of the marine vessel, such as that illustrated in FIGS. 2A-2E, without requiring steering control of the propulsion devices 21 and 22, which are mechanically steered by the steering wheel 12. Thus, the disclosed system and method control magnitude and forward or reverse direction of thrust for each parallel propulsion device without adjusting or otherwise controlling the drive angle of the set of parallel propulsion devices. However, the disclosed system requires that the system is configured to inhibit joystick thrust control mode offering lateral and rotational propulsion control until the steerable propulsion devices (e.g. 21 and 22) are centered. Thus, a customer-facing interface is required in order to instruct the user to operate the steering wheel 12 in order to rotate the propulsion devices. The user interface device indicates a steering position of the steerable propulsion device 21, 22 and or a direction that the user should rotate the steering wheel in order to bring the steerable propulsion device 21, 22 to the centered position. Position feedback is provided from one or more sensors on the marine vessel. Position sensing is provided by one or more sensors, such as a sensor on the steering wheel that senses a wheel position (wheel position sensor 74 in FIG. 1B) and/or a position sensor on at least one of the steerable propulsion devices 21, 22 (drive position sensor 44 in FIG. 1A) in order to sense a drive angle of the one or more propulsion devices 21, 22.

The disclosed system and method take advantage of the parallelism of the propulsion devices 21 and 22. Forward or reverse thrusts by the one or more propulsion devices 21, 22 may be effectuated and coupled with lateral thrust from the one or more lateral thrusters 15A-15C in order to impart the demanded translational or rotational movement of the vessel at the user input device 40. Where two or more parallel propulsion devices 21 and 22 are present, differential thrust between the propulsion devices may be utilized in some scenarios in order to effectuate rotational motion. By effectuating a forward thrust with one of the propulsion devices and a reverse thrust by the other, where the thrust vectors are parallel and equal in magnitude, the forward and reverse translation forces will couple and counteract one another. The coupled forces will impart a torque about the COT 30. Since the drive angle of the propulsion devices is known to be zero, or in the centered and straight ahead position, then vector analysis can be performed and the lateral thrust needed by the one or more lateral thrusters 15A-15C can be calculated. Thereby, lateral movement in the port direction 46 and the starboard direction 48, as well as forward direction 50 and reverse direction 52, can be effectuated. In certain embodiments, the system 100 may be configured to provide translational movement in other translational directions combining forward/reverse and port/starboard thrusts. Thereby, the disclosed propulsion system 100 enables joystick control to provide lateral and rotational thrust control for mechanically linked and/or steered drives. Accordingly, steer-by-wire is not required and the controller 34 is configured to calculate thrust magnitude and direction utilizing the centered position of the marine drives in order to effectuate various rotational and translational thrusts.

Figure 3:
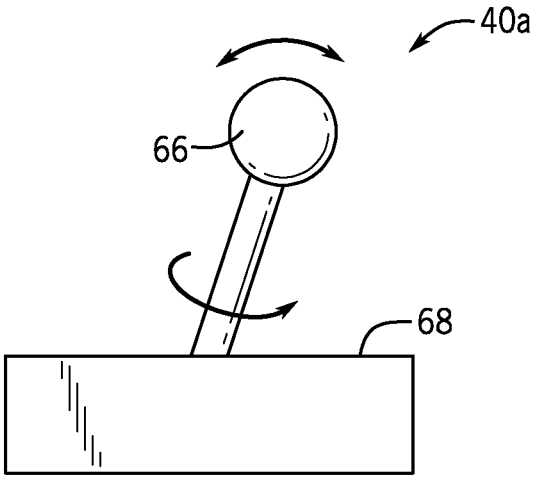
FIG. 3 illustrates an exemplary joystick user input device.
Figure 4:
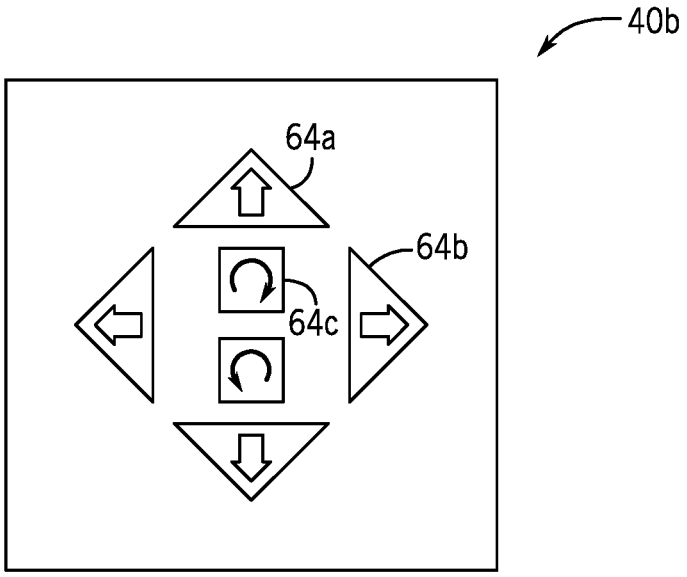
FIG. 4 illustrates an exemplary keypad user input device.

FIGS. 3 and 4 exemplify two possible types of user input devices 40. FIG. 3 depicts a well-known joystick device that comprises a base 68 and a moveable handle 66 suitable for movement by an operator. Typically, the handle can be moved left and right, forward and back, as well as rotated relative to the base 68 in order to provide corresponding movement commands for the propulsion system. The operation of joystick thrust control is well known to those skilled in the art and is also describes in references incorporated herein by reference. FIG. 4 depicts an alternative user input device 40*b* being a keypad with buttons 64 associated with each of the right, left, forward, backward, and rotational movement directions. Thus, a forward button 64*a* can be pressed by a user in order to provide a forward thrust command to move the marine vessel forward and key 64*b* can be pressed by a user to input a lateral thrust command to command lateral movement of the marine vessel 10. Similarly, the clockwise rotation key 64*c* can be pressed by a user to input a clockwise rotational thrust command to command clockwise rotational movement of the marine vessel 10. The other keys on the keypad 40*b* operate similarly.

Figure 5A:
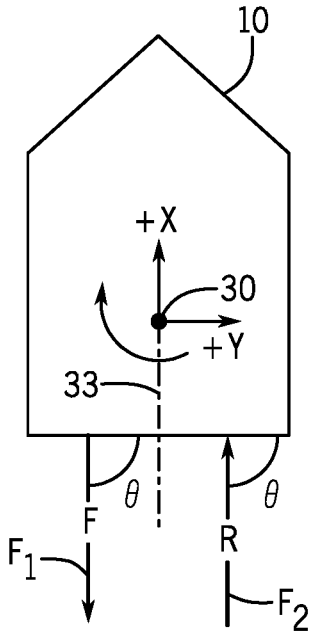
FIGS. 5A and 5B illustrate exemplary force vectors on a marine vessel by propulsion devices and/or thrusters.
Figure 5B:
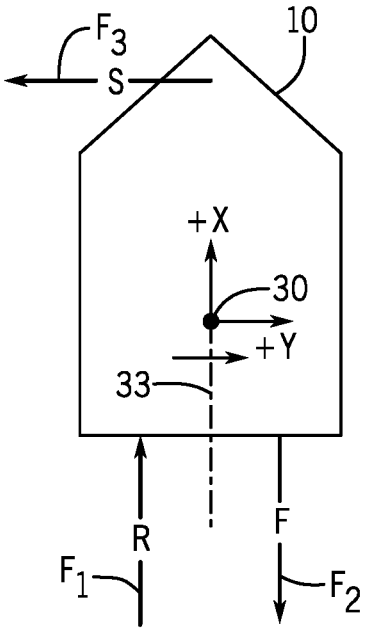

FIGS. 5A-5B exemplify this force coupling control between the propulsion devices 21 and 22 and the lateral thruster 15 in order to effectuate rotational and translational movement of the vessel without changing or controlling the drive angle of the propulsion devices 21 and 22. The controller 34 is configured to determine when angle θ of the parallel propulsion devices 21 and 22 reaches the centered position (perpendicular to the transom). In one embodiment, a drive position sensor 44 (FIG. 1A) is configured to sense a drive angle of at least one of the parallel propulsion devices 21 and 22. Given that the propulsion devices 21 and 22 are maintained in parallel, such as by a tie bar 23, the drive angle of only one propulsion device 21, 22 needs to be sensed. However, in other embodiments, each propulsion device 21 and 22 may be equipped with a position sensor, such as to provide redundancy in case of failure. The drive angle sensed by the position sensor provides information about the drive angle, or steering position, of the propulsion devices, which is manually controlled by the operator via the steering wheel 12 and is not controlled by the controller 34.

In another embodiment, the steering position of the one or more propulsion devices 21, 22 is determined based on steering wheel position as measured by wheel position sensor 74 each of the wheel position sensor 74 and the drive position sensor 44 may be any type of position sensors, such as rotary Hall Effect sensors, configurable for sensing the rotational position of the steering wheel 12 and the drive angle of the propulsion device 21, respectively. So long as the drive angle remains center, the joystick thrust mode can remain enabled. If the drive angle θ or steering wheel position associated with the centered drive position changes such that it is not within a predetermined range of the centered position, then the controller may disable the joystick thrust mode such that the user is no longer able to control thrust of the marine vessel via the user input device, such as the joystick or keypad.

In certain embodiments, the controller 34 may be configured to utilize yaw rate or other position information, such as from an inertial measurement unit 26 or other sensor capable of measuring rotational position of the marine vessel, as the basis for controlling thrust magnitude and forward/reverse direction. The sensed yaw rate, for example, may be used as feedback control for adjusting the thrust commands in order to effectuate the commanded rotational and/or translational movement. Namely, the controller 34 may determine an expected yaw rate associated with the lateral and/or rotational thrust command from the user input device and may compare the measured yaw rate from the IMU 26 to the expected yaw rate and adjust the thrust commands in order to reduce a difference between the measured yaw rate and the expected yaw rate.

In FIG. 5A the propulsion devices 21 and 22 effectuate opposite thrusts with equal magnitude so as to effectuate a clockwise rotational movement of the vessel 10. The force vectors from the propulsion devices on the port and starboard sides of the center line 33 on the stern of the marine vessel, and, where utilized, the thrust vector by the bow thruster 15, are added through normal vector analysis in order to result in the desired rotational and/or translational movement commanded at the user input device 40. Namely, the thrust vector F1 for the first propulsion device 21, or the total thrust of the propulsion devices on the port side of the center line 33, are in the forward thrust direction to effectuate forward movement of the marine vessel. The thrust vector F2 of the starboard-side propulsion device 22, or the sum of the propulsion devices on the starboard side of the center line 33 of the marine vessel 10 are in the reverse thrust direction so as to effectuate reverse movement of the marine vessel 10. The forward thrust vector F1 and the reverse thrust vector F2 are equal in magnitude such that the translational forces cancel and only a resultant moment is effectuated in order to turn the marine vessel in the clockwise rotational direction. Here, the bow thruster 15 is not operated and remains in the off state.

FIG. 5B depicts force vectors F1 through F3 effectuated to produce lateral movement of the vessel 10 in the starboard direction. Here, the lateral thruster 15 is activated in order to effectuate a starboard thrust vector F3 at the bow of the marine vessel. The thrust by the bow thruster 15 generates a clockwise moment about the center of turn 30 in addition to a lateral force in the starboard direction. The moment caused by the bow thruster 15 is counteracted by effectuating an equal and opposite moment with the propulsion devices 21 and 22 such that the resulting moment equals zero and only the lateral force F3 remains such that the marine vessel 10 is moved in the starboard direction. As will be recognized by a person having ordinary skill in the art in view of this disclosure, other combinations of thrust may be effectuated in order to accomplish the translational or rotational thrust commanded by the user.

Figure 6:
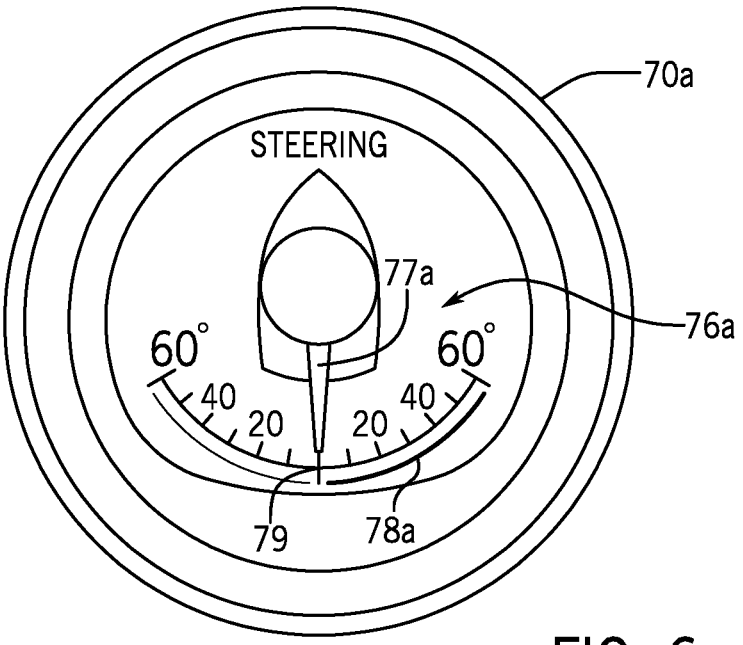
FIG. 6 provides an exemplary gauge representing drive angle of the one or more propulsion devices.
Figure 7:
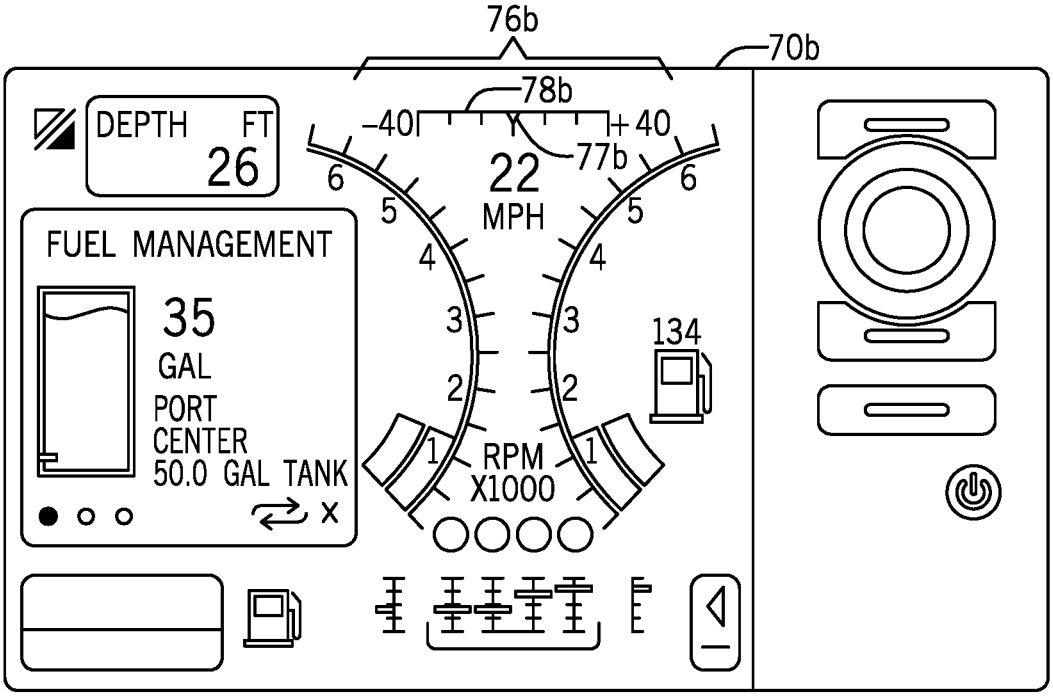
FIG. 7 depicts another exemplary gauge representing the drive angle of one or more propulsion devices.

FIGS. 6-9A and 9B depict various user interface devices configured to indicate at least one of the detected steering positions and or the difference between the depicted steering position and the centered steering position such that the user can center the marine drives as needed to engage the joystick thrust control mode. FIGS. 6-7 depict exemplary gauges that represent the drive angle θ of the at least one propulsion device 21, 22 with respect to the centered steering position. Referring to FIG. 6, the user interface 70*a* is a gauge 76*a* having a marker 77*a* being a needle that intersects a graph 78*a* corresponding to various potential steering positions, such as angles of the marine drive with respect to the centered steering position. The centered steering position is marked at the center point 79. Thus, when the needle 77*a* aligns with the center mark 79, the user will understand that the drives are in the centered steering position.

FIG. 7 depicts a digital gauge 76*b* on a user interface device 70 being a digital display. The digital display 70 may be any vessel display at the helm of a marine vessel. To provide just one example, the user interface device 70*b* may be a VesselView by Mercury Marine of Fond Du Lac, Wis. The digital gauge 70*b* has a marker 77*b* on a graph 78*b* that depicts the steering position of the one or more propulsion devices 21, 22 within the steerable range, as is described above with respect to the analog gauge depicted in FIG. 6.

Figure 8:
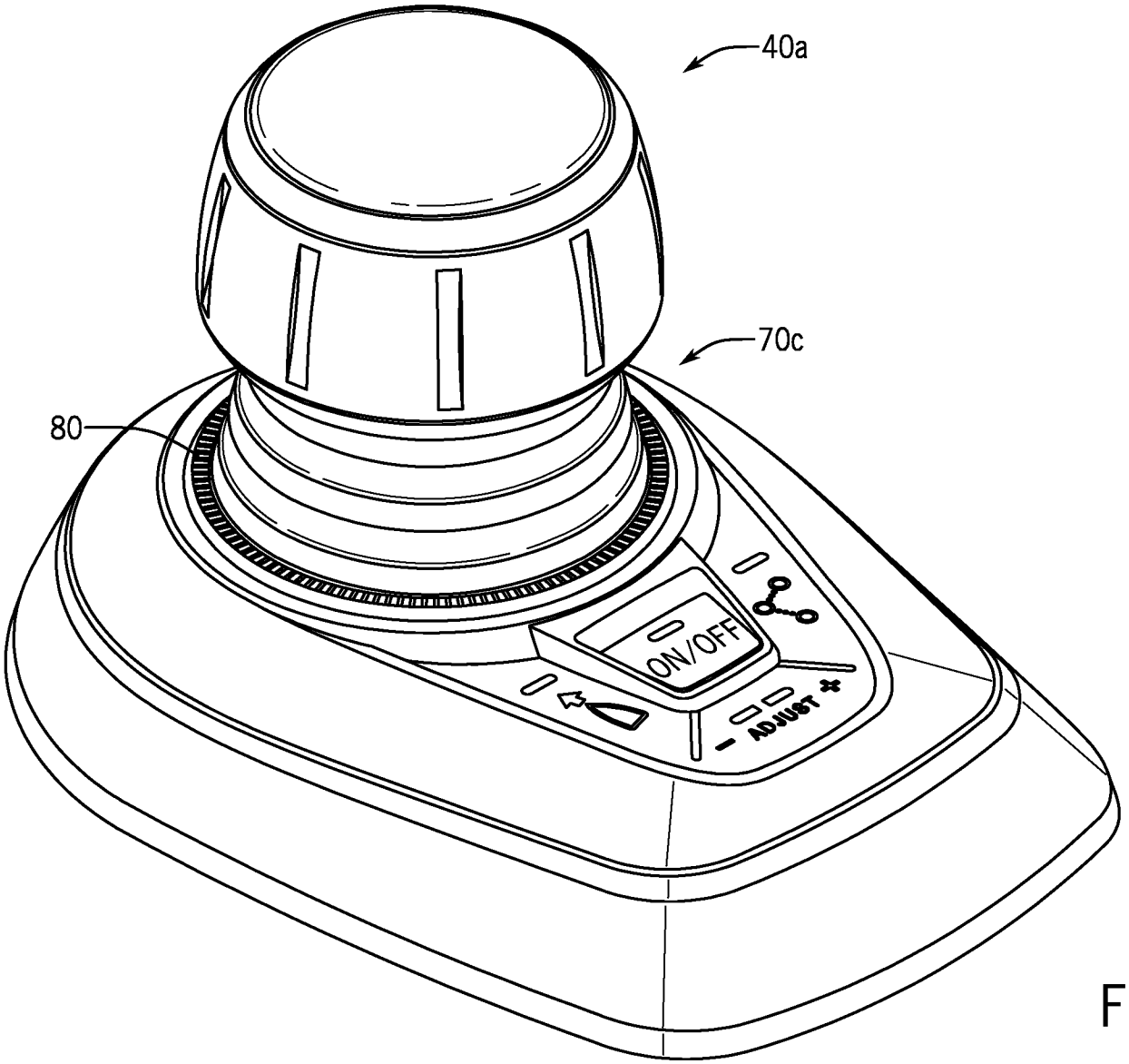
FIG. 8 depicts an exemplary user interface device having a display thereon being an illuminable ring.
Figure 9B:
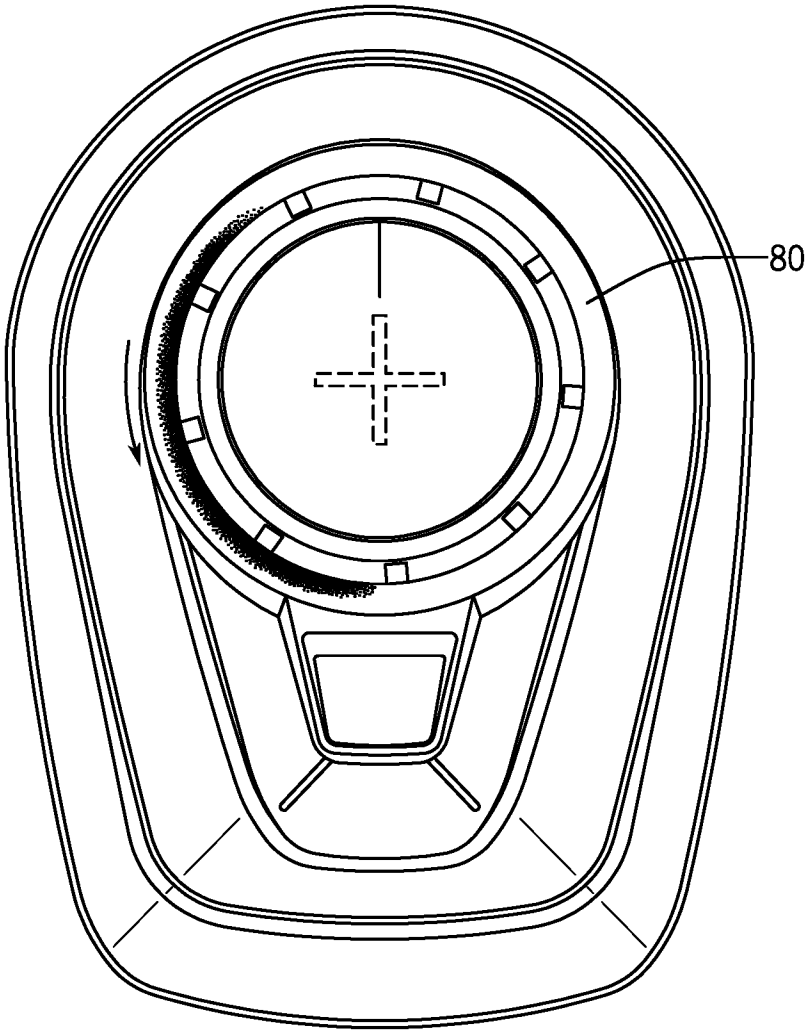
FIG. 9A-9B depict an exemplary illumination pattern on an exemplary illuminable ring on a joystick.
Figure 9A:
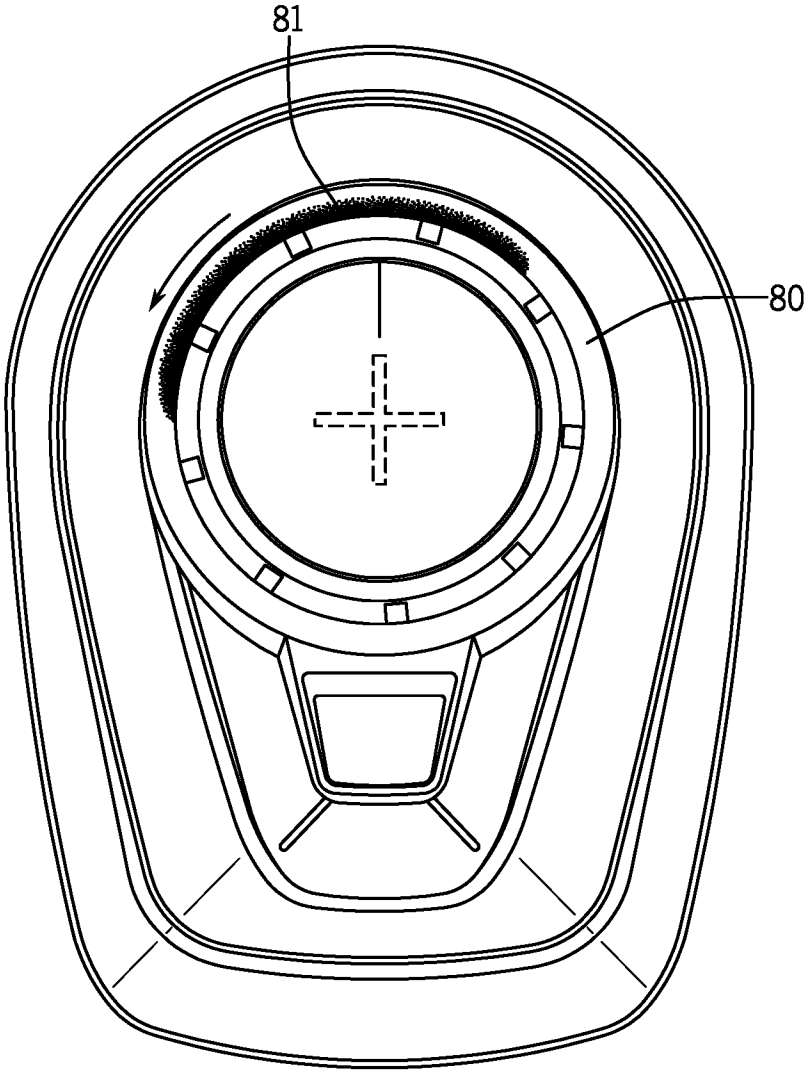

FIGS. 8 and 9A-9B depict another user interface device 70*c* configured to indicate the amount and direction the user must turn the wheel by illuminating an illuminable ring 80 on the joystick device 40*a*. As will be recognized by a person having ordinary skill in the art in view of the disclosure, the illuminable ring 80 may equally be provided on a keypad device, which is within the scope of the present disclosure. The illuminable ring 80 may be used alone to indicate the steering position information to the user, or may be used in conjunction with one or more gauges, such as those exemplified in FIGS. 6-7. The illuminable ring is illuminated in an illumination pattern that indicates an amount and or a direction that the user must turn the wheel. FIGS. 9A-9B provide a top view of the joystick 40*a* illustrating an exemplary illumination pattern to indicate that the user must turn the steering wheel in a counterclockwise direction. Namely, the illumination 81 circulates around the illuminable ring 80 in a counterclockwise rotation to indicate that the steering wheel 12 should be rotated counterclockwise to center the drives. Similarly, clockwise rotation of the illumination 81 around the illuminable ring 80 would indicate that the steering wheel 12 should be rotated in the clockwise direction to center the drives.

In certain embodiments, the frequency of rotation of the illumination 81 indicates the amount the drives need to be turned in order to reach the centered steering position. For example, a faster frequency of rotation indicates a larger amount of turn necessary to reach the centered steering position. As the steering wheel approaches the centered steering position, the frequency of rotation of the illumination 81 around the illuminable ring 80 may slow. In another embodiment, the length, size, or brightness of the illumination may indicate the amount that the steering wheel must be turned in order to reach the centered position. For instance, a long illumination 81 line rotating around the illuminable ring 80, such as that shown in FIGS. 9A-9B, may indicate that a significant change in steering angle is needed to reach the centered steering position, such as 20 degrees or more. As the one or more drives 21, 22 move toward the centered steering position, the length of the illumination 81 rotating around the illuminable ring 80 may decrease and may disappear once the steering wheel 12 reaches the centered steering position.

In certain embodiment, the illuminable ring 80 may also be controlled to indicate that the at least one marine drive 21, 22 is within the range of the centered steering position so as to indicate that the joystick control mode is enabled. For example, the entire illuminable ring 80 may illuminate, such as turn green, once the propulsion devices 21, 22 reach the centered steering position. In certain embodiments, the illumination of the illuminable ring 80 may continue while the joystick control mode is enabled.

Figure 10:
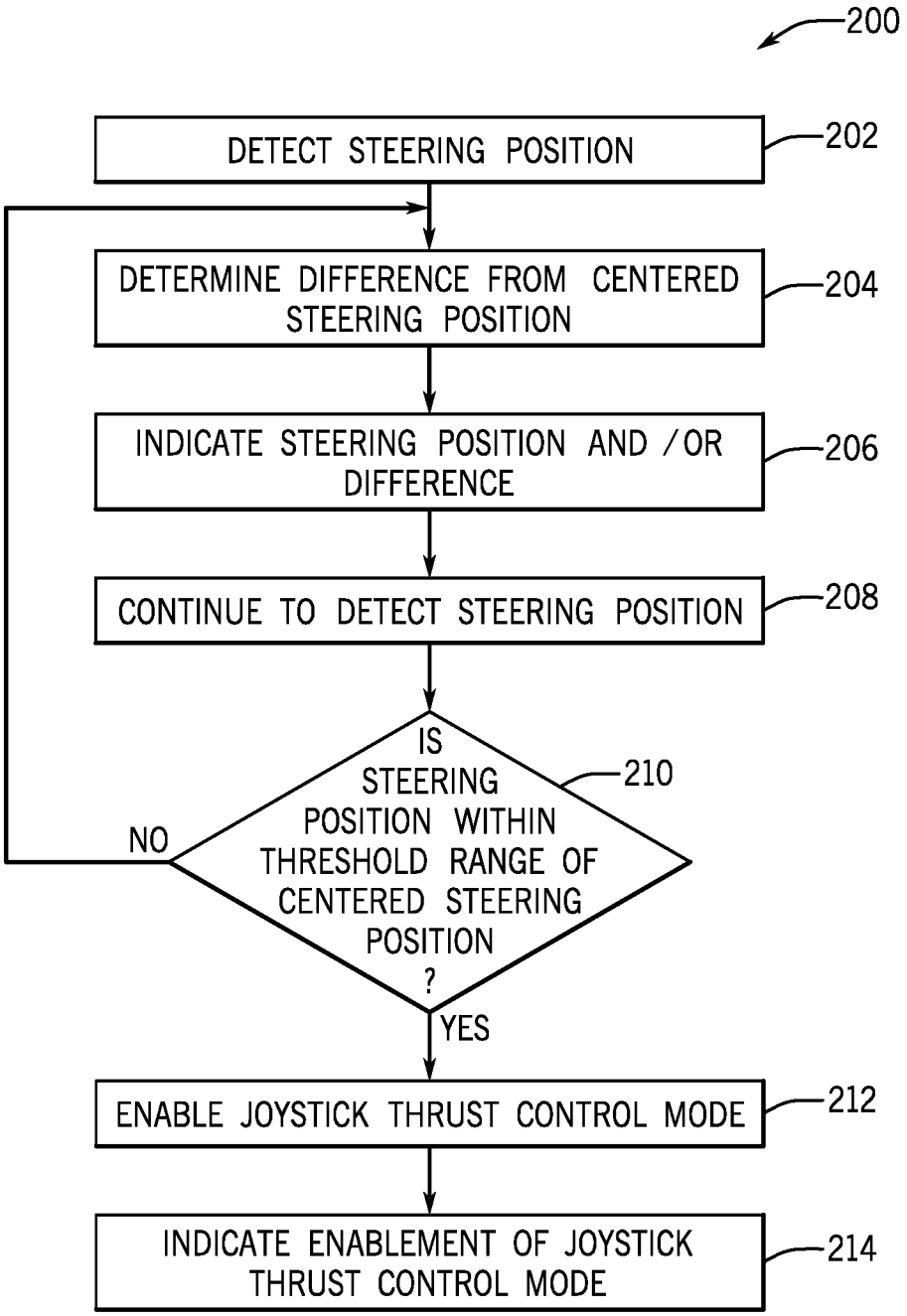
FIG. 10 is a flowchart demonstrating a method of controlling propulsion of a marine vessel in accordance with one embodiment of the present disclosure.

FIG. 10 depicts one embodiment of a method 200 of controlling propulsion to engage a joystick thrust control mode. The steering is position is detected at step 202, such as detecting a drive angle with a drive position sensor 44 or detecting a wheel angle with a wheel position sensor 74. A difference between the detected steering position and a centered steering position is determined at step 204, which is how much the at least one propulsion device 21, 22 must be turned in order to reach the centered steering position. The steering position and or the difference from the centered steering position is then indicated on a user interface device at step 206, such as via a digital or analog gauge and or via a light ring or other indicator on the joystick device, to provide a few examples. The steering position is redetected at step 208. If the steering position is within a threshold range of the centered steering position at step 210, then the joystick thrust control mode is enabled at step 212 such that the user can operate the user input device (e.g. the joystick or keypad) to control thrust in order to steer the marine vessel. Once the joystick thrust control mode is enabled, such enablement may be indicated on the user interface device at step 214. For example, the illuminable ring 80 may be configured to indicate enablement of the joystick thrust control mode. In other embodiments, a light indicator may illuminate elsewhere on the joystick device 40*a* to indicate enablement. In still other embodiments, the digital display of the user interface device 70*b* may provide indication of enablement of the joystick thrust control mode.

If the steering position is not within the threshold range of the centered steering position at step 210, then steps 204-208 are re-performed in order to instruct the user and or amount that the user must turn the steering wheel in order to reach the centered steering position. In various embodiments, the threshold range of the centered steering position may be a range of steering angles on either side of the straight-ahead steering position where the propulsion devices 21-22 are perpendicular to the transom 24. To provide just one example, the threshold range may be within plus or minus one degree of the centered steering position, or within a predefined percentage of the steering range.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A propulsion system on a marine vessel, the system comprising:

at least one steerable propulsion device rotatable to steer a marine vessel;

at least one lateral thruster configured to generate starboard and/or port thrusts to propel the marine vessel;

a steering wheel operable by a user to steer the at least one propulsion device, wherein the steering wheel is mechanically connected to the propulsion device such that it is mechanically steered;

a user input device operable by a user to provide at least a lateral thrust command to command lateral movement of the marine vessel and a rotational thrust command to command rotational movement of the marine vessel;

a controller configured to:

determine a steering position of the at least one propulsion device;

determine a difference between the steering position and a centered steering position;

control a user interface device to indicate at least one of the steering position and the difference between the steering position and the centered steering position to a user; and determine that the steering position is within a threshold range of the centered steering position prior to enabling a joystick thrust control mode wherein thrust by the propulsion device and the lateral thruster is controllable by the user input device.

2. The system of claim 1, further comprising at least two parallel propulsion devices that each generate forward and reverse thrusts, wherein the parallel propulsion devices are connected together by a tie bar such that their thrusts are parallel; and wherein thrust by each of the parallel propulsion devices controllable by the user input device.

3. The system of claim 2, further comprising at least one drive position sensor configured to sense a drive angle of at least one of the parallel propulsion devices, wherein steering position is the drive angle of the parallel propulsion devices.

4. The system of claim 1, further comprising at least one bow lateral thruster and at least one stern lateral thruster; and wherein thrust by the at least one propulsion device and the bow lateral thruster and the stern lateral thrusters are controllable by the user input device.

5. The system of claim 1, further comprising a wheel position sensor configured to sense an angle of the steering wheel, and wherein steering position is the angle of the steering wheel.

6. The system of claim 1, wherein the controller is further configured to, prior to determining the difference between the steering position and a centered steering position, receive a user input to engage the joystick thrust control mode.

7. The system of claim 1, wherein the controller is further configured to indicate on the user input device an amount and direction that the user must turn the steering wheel to reach the centered steering position.

8. The system of claim 7, wherein the user interface device is an illuminable ring and wherein the controller is configured to indicate the amount and direction that the user must turn the steering wheel by illuminating the illuminable ring in an illumination pattern.

9. The system of claim 8, wherein the controller is further configured to illuminate the entire illuminable ring once the at least one propulsion device is within the range of the centered steering position so as to indicate that the joystick thrust control mode is enabled.

10. The system of claim 8, wherein the user input device is a joystick or a keypad, and wherein the illuminable ring is on the joystick is or on the keypad.

11. The system of claim 1, wherein steering position is a drive angle of the propulsion device, and wherein the controller is configured to indicate the drive angle of the propulsion device on the user interface device.

12. The system of claim 11, wherein the user interface device is a gauge representing the drive angle of the at least one propulsion device with respect to the centered steering position.

13. A method of controlling propulsion of a marine vessel, the method comprising:

detecting a steering position of at least one propulsion device;

determining a difference between the detected steering position and a centered steering position;

indicating on a user interface device at least one of the detected steering position and the difference between the detected steering position and the centered steering position to a user; and requiring, by a controller, that the detected steering position be within a threshold range of the centered steering position prior to enabling a joystick thrust control mode wherein thrust by the propulsion device and one or more lateral thrusters is controlled based on user input at a user input device.

14. The method of claim 13, wherein the user input device is one of a joystick or a keypad enabling a user to provide at least a lateral thrust command to command lateral movement of the marine vessel and a rotational thrust command to command rotational movement of the marine vessel.

15. The method of claim 13, wherein the at least one propulsion device includes at least two parallel propulsion devices that are connected together by a tie bar and are mechanically steered, and wherein steering position is a drive angle of the one or more parallel propulsion devices measured by a drive position sensor.

16. The method of claim 13, wherein the at least one propulsion device is mechanically steered, and wherein steering position is an angle of a steering wheel measured by a wheel position sensor.

17. The method of claim 13, further comprising, prior to executing the step of determining the difference between the detected steering position and a centered steering position, receiving a user input to engage the joystick thrust control mode.

18. The method of claim 13, wherein indicating at least one of the detected steering position and the difference between the detected steering position and the centered steering position to the user includes indicating on the user interface device a direction that the user must turn a steering wheel to reach the centered steering position.

19. The method of claim 18, further comprising indicating on the user interface device an amount that the user must turn the steering wheel to reach the centered steering position.

20. The method of claim 13, wherein indicating at least one of the detected steering position and the difference between the detected steering position and the centered steering position to the user includes indicating on the user interface device a direction and magnitude of the difference between the detected steering position and the centered steering position.

21. The method of claim 20, wherein indicating the direction and magnitude of the difference includes illuminating an illuminable ring in an illumination pattern, wherein the illumination pattern rotates in a direction corresponding to the direction that the user must turn a steering wheel to reach the centered steering position and at a frequency of rotation based on the magnitude that the user must turn the steering wheel to reach the centered steering position.

22. The method of claim 21, further comprising illuminating the entire illuminable ring once the at least one propulsion device is within the range of the centered steering position so as to indicate that the joystick thrust control mode is enabled.

23. The method of claim 13, wherein steering position is a drive angle of the propulsion device, and wherein indicating at least one of the detected steering position and the difference between the detected steering position and the centered steering position to the user includes indicating the drive angle.

* * * * *